US007245067B2

(12) United States Patent
Lee et al.

(10) Patent No.: US 7,245,067 B2
(45) Date of Patent: Jul. 17, 2007

(54) ELECTRON EMISSION DEVICE

(75) Inventors: Sang-Jo Lee, Suwon-si (KR); Chun-Gyoo Lee, Suwon-si (KR); Byong-Gon Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 234 days.

(21) Appl. No.: 11/130,103

(22) Filed: May 17, 2005

(65) Prior Publication Data

US 2005/0258730 A1 Nov. 24, 2005

(30) Foreign Application Priority Data

May 18, 2004 (KR) ..... 10-2004-0035127

(51) Int. Cl.
*H01J 9/02* (2006.01)

(52) U.S. Cl. ..... 313/310; 313/309; 313/495

(58) Field of Classification Search ..... 313/495, 313/309, 310, 336, 351
See application file for complete search history.

(56) References Cited

U.S. PATENT DOCUMENTS 6,420,726 B2 7/2002 Choi et al.
6,515,640 B2 * 2/2003 Tsukamoto et al. ..... 345/75.2
2004/0222734 A1 * 11/2004 Oh ..... 313/497

* cited by examiner

*Primary Examiner*—Vip Patel
(74) *Attorney, Agent, or Firm*—H. C. Park & Associates, PLC

(57) ABSTRACT

An electron emission device can include gate electrodes formed on a substrate and cathode electrodes insulated from the gate electrodes with an insulating layer interposed between them. Each cathode electrode can have a receptor at a peripheral side. Electron emission regions may be formed within the receptors and in contact with the cathode electrodes. Counter electrodes can face the cathode electrodes, can be coplanar with the cathode electrodes, and can be coupled to the gate electrodes. The shortest distance between the electron emission region and the counter electrode may be smaller than the shortest distance between the cathode electrode and the counter electrode.

15 Claims, 4 Drawing Sheets

ELECTRON EMISSION DEVICE

CROSS REFERENCE TO RELATED APPLICATION

This application claims priority to and the benefit of Korean Patent Application No. 10-2004-0035127 filed May 18, 2004, which is incorporated herein by reference in its entirety.

BACKGROUND OF THE INVENTION

1. Field of the Invention

The present invention relates, for example, to an electron emission device. More particularly, it relates, for example, to an electron emission device with an enhanced arrangement of electron emission regions and driving electrodes.

2. Description of Related Art

Electron emission devices using a cold cathode as an electron emission source include several types: field emitter array (FEA), surface conduction emitter (SCE), and metal-insulator-metal (MIM).

The FEA-type electron emission devices work because when material with a low work function or a high aspect ratio is used to form electron emission regions, electrons are easily emitted from the electron emission regions under the vacuum atmosphere due to the electric field. The electron emission regions may be formed with a sharp front tip structure mainly based on, for example, molybdenum Mo or silicon Si, or with a carbonaceous material, such as carbon nanotube, graphite, or diamond-like carbon.

The common FEA-type electron emission display has a structure in which first and second substrates form a vacuum vessel, and cathode and gate electrodes are formed on the first substrate, insulated from each other. Electron emission regions are formed on the first substrate and are coupled to the cathode electrodes. Phosphor layers and an anode electrode are formed on the second substrate. The anode electrode makes the electrons emitted from the electron emission regions accelerate toward the phosphor layers.

Cathode electrodes, an insulating layer, and gate electrodes are sequentially formed on the first substrate. Openings are formed at the gate electrodes and the insulating layer. The cathode electrodes are exposed to the outside. Electron emission regions are formed on the exposed portions of the cathode electrodes.

However, with the above-structured electron emission device, when the carbonaceous material paste is injected into the openings and fired to form electron emission regions, the conductive carbonaceous material straddles the cathode and the gate electrodes. This can cause the two electrodes to short-circuit. In order to prevent short-circuiting, it is possible to use a sacrificial layer. However, the processing steps for using the sacrificial layer approach are complicated, and the etchant for removing the sacrificial layer tends to damage other structural components.

U.S. Pat. No. 6,420,726 discloses a structure in which gate electrodes are arranged between the substrate with electron emission regions and cathode electrodes. As the electron emission regions are positioned at the topmost area of the substrate, they can be easily formed using a screen printing technique.

However, with the above structure, the shape and the arrangement of the electron emission regions as well as the interconnection structure of the cathode electrodes and the electron emission regions greatly influence electron emission. Accordingly, when such structural components are not made in a suitable manner, electrons emitted from the electron emission regions can incorrectly stimulate light emission in the phosphor layers of an incorrect pixel (usually a neighboring pixel). In this case, electron emission efficiency deteriorates, and it becomes difficult to obtain the desired screen brightness.

SUMMARY OF THE INVENTION

The present invention provides, for example, an electron emission device that can correctly control each pixel's electron emission of the electron emission region. An electron emission device of the present invention may heighten the intensity of the electric fields applied to the electron emission regions and thus increase the amount of emitted electrons. This may be accomplished while preventing electron emission at unintended locations, thereby enhancing screen image quality.

Additional features of the invention will be set forth in the description which follows, and in part will be apparent from the description, or may be learned by practice of the invention.

In an example embodiment of the present invention, an electron emission device can include gate electrodes formed on a substrate, and cathode electrodes insulated from the gate electrodes with an insulating layer interposed between them. Each cathode electrode can have a receptor at a peripheral side. Electron emission regions can be formed within the receptors and in contact with the cathode electrodes. Counter electrodes can face the cathode electrodes in the same plane as the cathode electrodes and can be coupled to the gate electrodes. The shortest distance between the electron emission region and the counter electrode can be smaller than the shortest distance between the cathode electrode and the counter electrode.

It is to be understood that both the foregoing general description and the following detailed description are for purposes of example and are intended to provide further explanation of the invention.

DETAILED DESCRIPTION OF THE INVENTION

Figure 1:
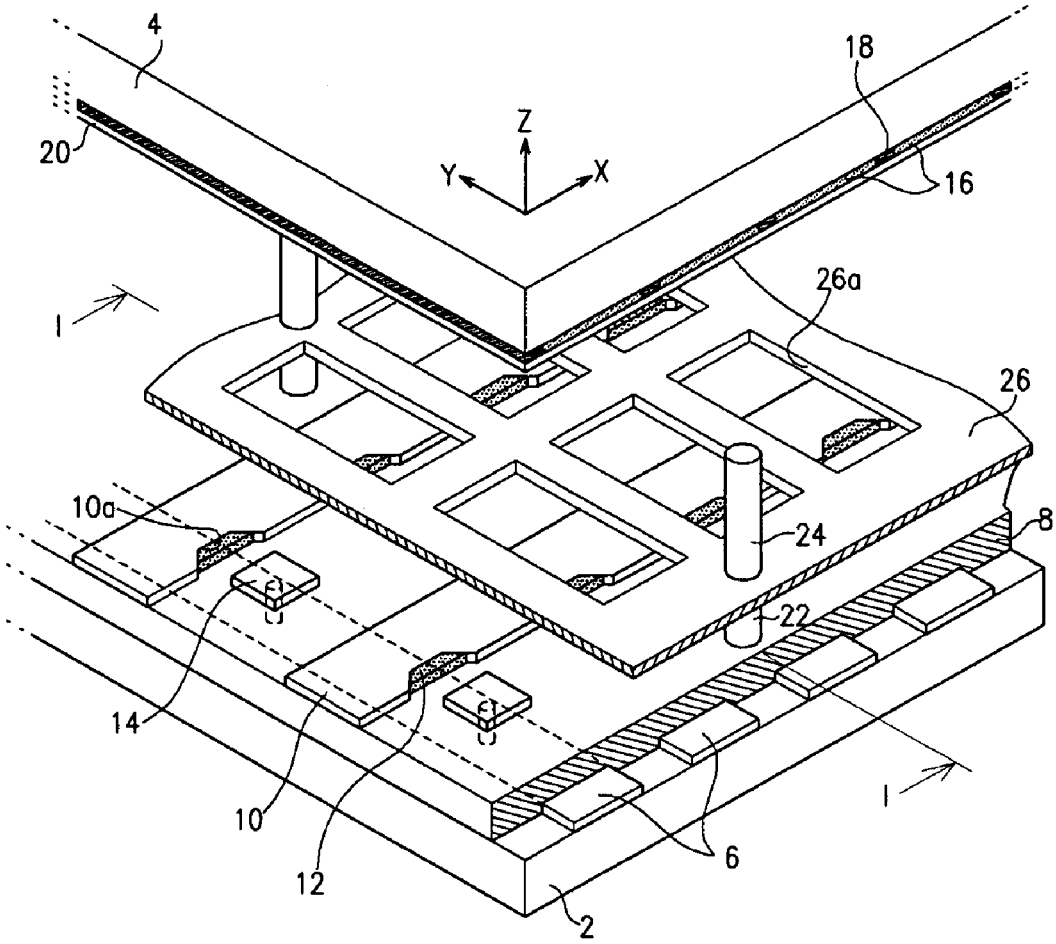
FIG. 1 is a partial exploded perspective view of an electron emission device of a first embodiment of the present invention.
Figure 2:
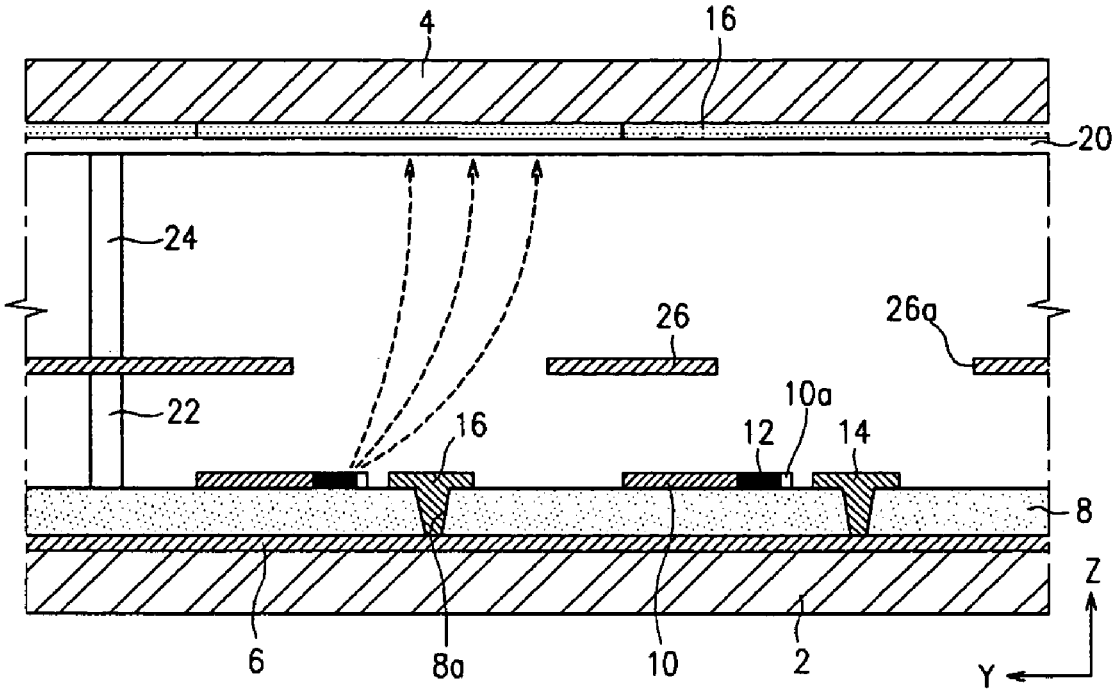
FIG. 2 is a partial sectional view of the electron emission device shown in FIG. 1.

The present invention will now be described in detail with reference to the accompanying drawings in which example embodiments of the invention are shown. The invention may, however, be embodied in different forms and should not be construed as limited to the embodiments shown and described. The dimensions in the drawings are exaggerated for clarity. The same reference numerals are used to denote the same elements throughout the specification.

As shown in FIG. 1, FIG. 2, FIG. 3, and FIG. 4, an electron emission device of a first embodiment of the present invention can include first and second substrates 2 and 4 arranged substantially parallel to each other at a predetermined distance (forming an inner space).

An electron emission structure can be provided at the first substrate 2 to emit electrons. A light emission or display structure can be provided at the second substrate 4 to emit visible rays due to the electrons and display the desired images.

First, gate electrodes 6 are formed on the first substrate 2, for instance, with a stripe pattern while proceeding in a direction of the first substrate 2 (in the Y direction of the drawing). An insulating layer 8 is formed on the entire surface of the first substrate 2 while covering the gate electrodes 6. Cathode electrodes 10 can be formed on the insulating layer 8. For instance, they may be formed with a stripe pattern and may be perpendicular to the gate electrodes 6 (in the X direction of the drawing).

The electron emission regions 12 contact the cathode electrodes 10. When regions where the cathode electrodes 10 and the gate electrodes 6 cross are the pixel regions, the electron emission region 12 can be provided at each pixel region at a peripheral side of the cathode electrode 10.

A peripheral side of the cathode electrode 10 can be partially removed to form a receptor 10*a*. The electron emission region 12 can be placed within the receptor 10*a* such that a lateral side thereof contacts a lateral side of the cathode electrode 10.

With the receptor 10*a* formed at the cathode electrode 10, the electric fields for making electron emission may be concentrated on a peripheral side of the electron emission region 12 (which may not be surrounded by the cathode electrode 10 but may remain open). The portion of the cathode electrode 10 disposed between electron emission regions may help to form a barrier and intercept electric fields from going to an incorrect electron emission region 12.

When a peripheral side of the electron emission region 12 that is not surrounded by the cathode electrode 10 but remains open, is placed within the receptor 10*a*, intrusion of the electric field to the incorrect electron emission region 12 due to the driving voltage applied to the neighboring pixels can be intercepted more effectively.

Electron emission regions 12 may be formed with a material that emits electrons when an electric field is applied in a vacuum atmosphere. The material can be carbonaceous material and nanometer-sized. The electron emission regions 12 may be formed, for example, with carbon nanotube, graphite, graphite nanofiber, diamond, diamond-like carbon, $C_{60}$, silicon nanowire, or a combination of these. The formation of the electron emission regions 12 may be made through screen printing, chemical vapor deposition, direct growth, sputtering, or the like.

Counter electrodes 14 are formed at the first substrate 2 to draw the electric field of the gate electrodes 6 over the insulating layer 8. The counter electrodes 14 contact the gate electrodes 6 through via holes 8*a* formed at the insulating layer 8 while being coupled thereto. The counter electrodes 14 are provided at the respective pixel regions between the cathode electrode neighbors 10, and spaced apart from the electron emission regions 12 with a distance.

When predetermined driving voltages are applied to the cathode and the gate electrodes 10 and 6 to form electric fields around the electron emission regions 12, the counter electrodes 14 can intensively apply electric fields to the peripheries of the electron emission regions 12. Accordingly, even when a low driving voltage is applied to the gate electrodes 6, electrons can emit well from the electron emission regions 12.

In this embodiment, the counter electrodes 14 are roughly square. However, the shape of the counter electrodes is not limited to this shape, but can be any suitable shape or pattern.

Figure 3:
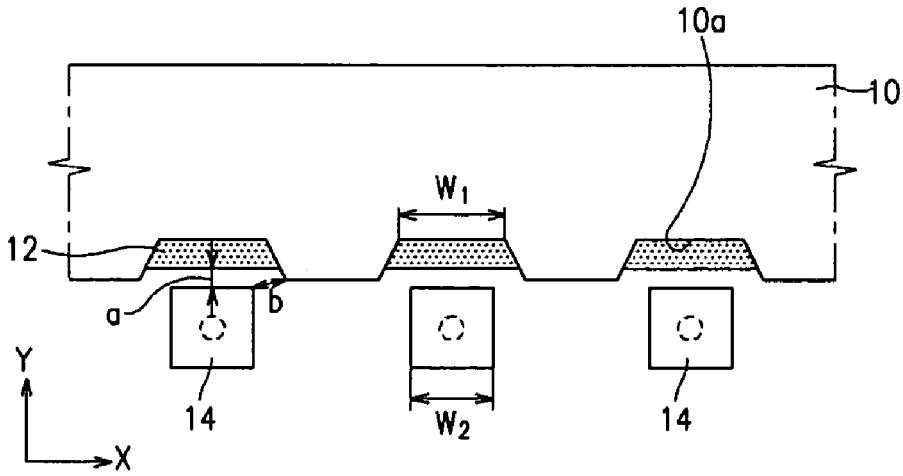
FIG. 3 is a partial plan view of the electron emission device of the first embodiment of the present invention.

The shortest distance between the electron emission region 12 and the counter electrode 14 may be selected to be smaller than that between the cathode electrode 10 and the counter electrode 14. That is, as shown in FIG. 3, the shortest distance "a" between the electron emission region 12 and the counter electrode 14 at each pixel region may be smaller than the shortest distance "b" between the cathode electrode 10 and the counter electrode 14 (i.e. a<b).

When a is less than b, a stronger electric field can be applied to the electron emission region 12, thereby increasing the amount of emitted electrons. Furthermore, even if material for the electron emission region 12 is misplaced at any undesired portion of a peripheral side of the cathode electrode 10 directed toward the counter electrode 14, electron emission at that area may be inhibited (by the greater distance b). Thus, electron emission at unwanted areas can be effectively prevented.

An arrangement of the electron emission regions 12 and the counter electrodes 14 for satisfying the above-identified structural conditions will be now explained in detail.

The receptor 10*a* of the cathode electrode 10 may be tapered from a peripheral side of the cathode electrode 10 directed toward the counter electrode 14 to the inside of the cathode electrode 10. The tapering may include narrowing the width of the receptor 10*a*. For instance, the receptor 10*a* may be trapezoidal. The periphery of the electron emission region 12 facing the counter electrode 14 may be placed within the receptor 10*a*.

Figure 4:
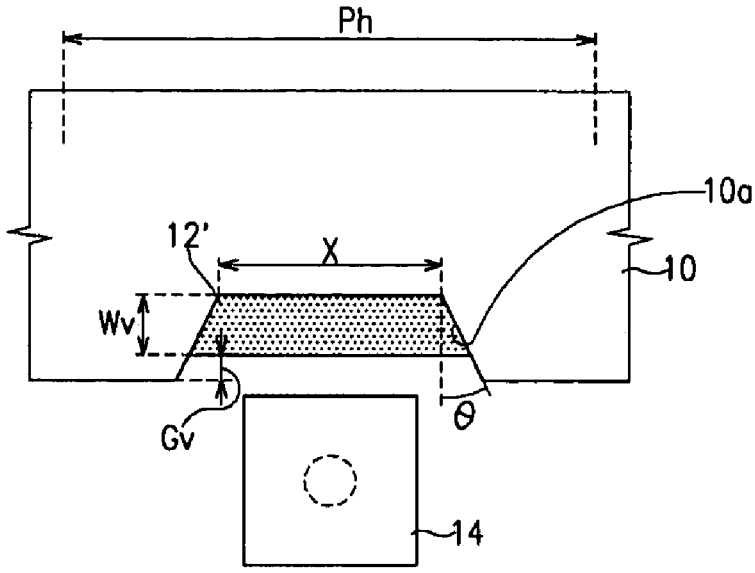
FIG. 4 is a partial amplified view of the electron emission device shown in FIG. 3.

With the above structure, and as shown in FIG. 4, the lateral inclination θ of the cathode electrode receptor 10*a* with respect to the width of the cathode electrode 10 may be set to satisfy the following condition:

$$\max\left[\tan^{-1}\left(\frac{-X}{2(W_v+G_v)}\right), -\frac{\pi}{2}\right] < \theta < \min\left[\tan^{-1}\left(\frac{P_h-X}{2(W_v+G_v)}\right), \frac{\pi}{2}\right] \quad (1)$$

in which X is the minimum width of the electron emission region 12 in the longitudinal direction of the cathode electrode 10, Wv is the width of the electron emission region 12 in the width direction of the cathode electrode 10, Gv is the distance between the electron emission region 12 and the front end of the receptor 10*a* in the width direction of the cathode electrode 10, and Ph is the pitch of the pixel region measured in the longitudinal direction of the cathode electrode 10.

As shown in FIG. 3, the minimum width of the cathode electrode receptor 10*a* measured in the longitudinal direction of the cathode electrode 10 is indicated by $W_1$ and the width of the counter electrode 14 measured in that direction is indicated by $W_2$. $W_2$ may be set to be less than or equal to $W_1$(i.e. $W_1 \geqq W_2$). Accordingly, the shortest distance "a" between the electron emission region 12 and the counter electrode 14 may be set smaller than the shortest distance "b" between the cathode electrode 10 and the counter electrode 14.

Moreover, with the structure of the present embodiment in which the cathode electrode receptors 10*a* and the electron emission regions 12 are provided, the periphery of the electron emission region 12 opened toward the counter electrode 14 is elongated, thereby increasing the electron emission area of the electron emission region 12.

Red, green and blue phosphors 16 may be formed on the surface of the second substrate 4 facing the first substrate 2 (spaced apart from each other), and black layers 18 may be formed between the phosphor layers 16 to enhance the screen contrast. An anode electrode 20 may be formed on the phosphor layers 16 and the black layers 18 with a metallic layer (mainly, an aluminum layer). The anode electrode 20 can receive the voltage required for accelerating electron beams from the outside, and can enhance the screen brightness due to the metal back effect thereof.

Alternatively, instead of a metallic layer, the anode electrode may be formed with a transparent conductive layer, such as indium tin oxide (ITO) or indium zinc oxide (IZO). In such a case, an anode electrode (not shown) may be first formed on the second substrate 4 with a transparent conductive material, and phosphor layers 16 and black layers 18 may be formed on the anode electrode. If needed, a metallic layer may be formed on the phosphor layers 16 and the black layers 18 to heighten the screen brightness. The anode electrode may be formed on the entire surface of the second substrate 4, or may be partitioned with a predetermined pattern.

The above structured first and second substrates 2 and 4 are aligned to each other with a predetermined distance such that the cathode electrode 10 faces the anode electrode 20, and attached to each other by using a sealing material, such as a frit. The inner space between the first and the second substrates 2 and 4 is exhausted to be in a vacuum state, thereby constructing an electron emission device.

Spacers 22 and 24 may be arranged at the non-light emitting area between the first and the second substrates 2 and 4 to space them apart from each other. Lower spacers 22 may abut the first substrate 2, and upper spacers 24 may abut the second substrate 4.

In addition, a mesh-shaped grid electrode 26 with a plurality of holes 26*a* may be disposed between the upper and the lower spacers 24 and 22 within the vacuum vessel formed by the first and the second substrates 2 and 4. When arcing occurs within the vacuum vessel, the 20 grid electrode 26 can prevent the tendency of arcing to occur toward the cathode electrodes 10, and can focus emitted electrons from the electron emission regions 12.

The grid electrode 26 may be structured such that the holes 26*a* thereof correspond to the respective pixel regions on the first substrate 2, or (alternatively) the holes 26*a* of the grid electrode 26 may be arranged irregularly.

Such an electron emission device may be driven by applying predetermined voltages to the gate electrodes 6, the cathode electrodes 10, the grid electrode 26 and the anode electrode 20. For instance, driving voltages may be applied to the cathode and the gate electrodes 10 and 6 with a voltage difference of several tens to several hundred volts. A positive (+) voltage of several tens to several hundred volts may be applied to the grid electrode 26, and a positive (+) voltage of several hundred to several tens volts may be applied to the anode electrode 20.

Accordingly, a strong electric field may be applied to the periphery of the electron emission region 12 due to the voltage difference between the gate electrode 6 and the cathode electrode 10, and electrons may emit from it. The emitted electrons may pass through the holes 26*a* of the grid electrode 26, and may be attracted by the high voltage applied to the anode electrode 20. Subsequently, they may land on the phosphor layers 16 at the relevant pixels, and cause them to emit light and display the desired images.

Figure 5:
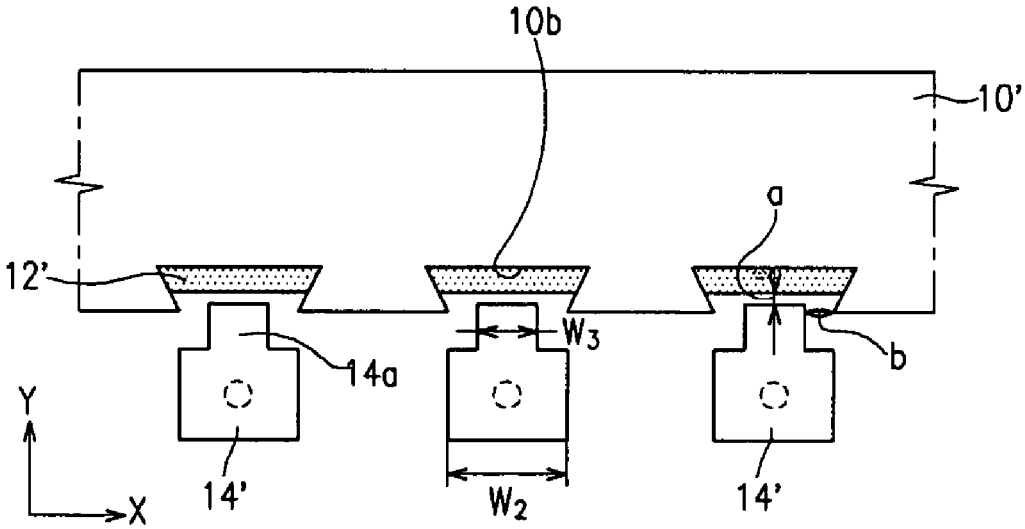
FIG. 5 is a partial plan view of an electron emission device of a second embodiment of the present invention.
Figure 6:
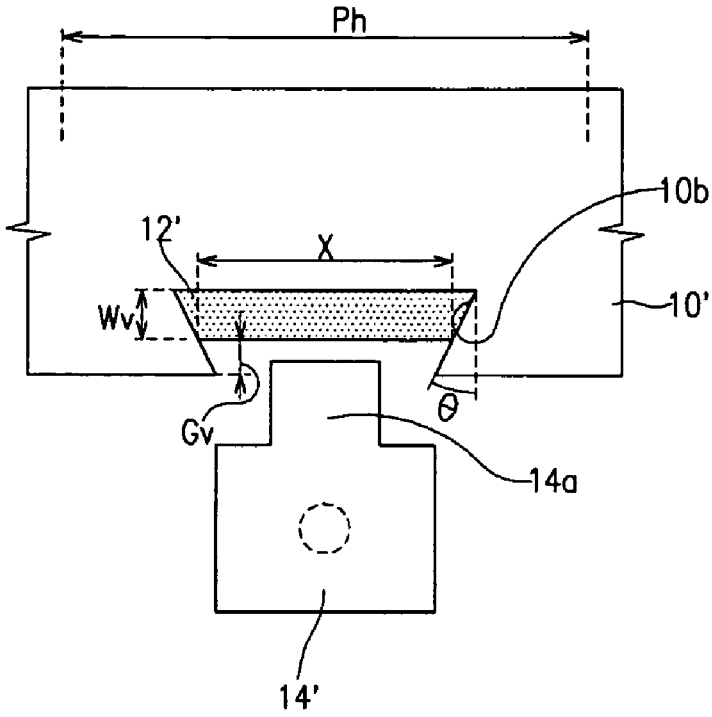
FIG. 6 is a partial amplified view of the electron emission device shown in FIG. 5.

FIG. 5 and FIG. 6 are partial plan views of an electron emission device of a second embodiment of the present invention. The structural components of the electron emission device may be the same as those related to the first embodiment except that the cathode electrode receptors and the counter electrodes can have a different structure.

The cathode electrode receptor 10*b* may be tapered from a peripheral side of the cathode electrode 10' facing the counter electrode 14' to the inside of the cathode electrode 10' while widening. For instance, the receptor 10*b* may have an inverted-trapezoidal shape. The periphery of the electron emission region 12' opening toward the counter electrode 14' may be placed within the receptor 10*b*.

The counter electrode 14' can have a protrusion 14*a* extending to the inside of the receptor 10*b*. The protrusion 14*a* can have a width $W_3$ smaller than the width $W_2$ of the counter electrode 14' measured in the longitudinal direction of the cathode electrode 10' (thus, $W_2 \geqq W_3$). The protrusion 14*a* may be spaced apart from the cathode electrode 10' with a suitable distance, and may extend inside of the receptor 10*b*.

With the above structure, as shown in FIG. 6, the lateral inclination θ of the cathode electrode receptor 10*b* with respect to the width of the cathode electrode 10' can be set to satisfy the following formula:

$$\max\left[\tan^{-1}\left(\frac{P_h - X}{2(W_v + G_v)}\right), \frac{\pi}{2}\right] < \theta < \min\left[\tan^{-1}\left(\frac{-X}{2(W_v + G_v)}\right), -\frac{\pi}{2}\right] \quad (2)$$

in which X is the minimum width of the electron emission region 12' in the longitudinal direction of the cathode electrode 10', Wv is the width of the electron emission region 12' in the width direction of the cathode electrode 10', Gv is the distance between the electron emission region 12' and the front end of the receptor 10*b* in the width direction of the cathode electrode 10', and Ph is the pitch of the pixel region measured in the longitudinal direction of the cathode electrode 10'.

Accordingly, the shortest distance "a" between the electron emission region 12' and the counter electrode 14' may be set smaller than the shortest distance "b" between the cathode electrode 10' and the counter electrode 14'.

Figure 7:
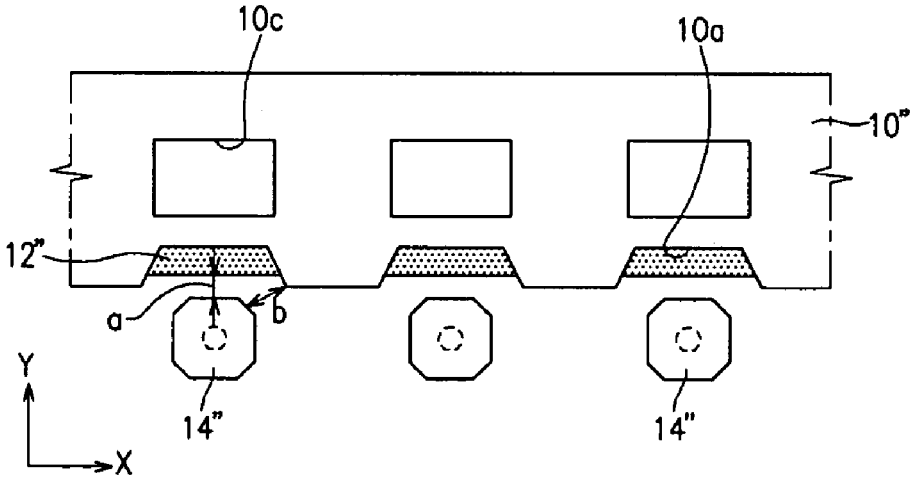
FIG. 7 is a partial plan view of an electron emission device of a third embodiment of the present invention.

FIG. 7 is a partial plan view of an electron emission device of a third embodiment of the present invention. The structural components of the electron emission device are the same as those related to the first embodiment except that the cathode electrodes and the counter electrodes have a different structure.

As shown in FIG. 7, the cathode electrode 10" may internally include an electric field reinforcing portion 10*c*, which may be formed by partially removing the cathode electrode 10" and exposing the insulating layer. The electric field of the underlying gate electrode affects the electron emission region 12" via the electric field reinforcing portion 10*c*.

The electron emission region 12" may be disposed between the counter electrode 14" and the electric field reinforcing portion 10*c*, and may thereby receive a stronger electric field when the device is driven. Accordingly, the electron emission device with the electric field reinforcing portion 10*c* can emit electrons from the electron emission regions 12" well, even with a lower driving voltage. In the drawing, the electric field reinforcing portion 10*c* is rectangular. However, the shape of the electric field reinforcing portion 10*c* can be any suitable shape or pattern.

Furthermore, compared to the counter electrode 14 shown in FIG. 3 of the first embodiment, the counter electrode 14" of the present embodiment is octagonal-shaped by cutting the four corners of the counter electrode 14 in an inclined manner. In this case, the shortest distance "a" between the electron emission region 12" and the counter electrode 14" is decreased while increasing the shortest distance "b" between the counter electrode 14" and the cathode electrode 10".

Consequently, with an electron emission device of the present embodiment, the effects exerted when the shortest distance between the electron emission region 12" and the counter electrode 14" is smaller than that between the cathode electrode 10" and the counter electrode 14" can be obtained more efficiently.

As described above, electron emission can be controlled more correctly, and the electric fields can be concentrated on the electron emission regions, thereby increasing the amount of emitted electrons. Furthermore, electron emission made at the unintended area is effectively prevented, and the phosphor layers are correctly light-emitted with a suitable brightness, thereby enhancing the screen image quality.

Although the invention has been particularly described with reference to certain embodiments thereof, changes may be made to these embodiments without departing from the scope of the invention.

What is claimed is:

1. An electron emission device, comprising:

a gate electrode formed on a first substrate;

a cathode electrode insulated from the gate electrode with an insulating layer interposed between them, and the cathode electrode has a receptor at a peripheral side;

an electron emission region formed within the receptor and in contact with the cathode electrode; and a counter electrode facing and coplanar with the cathode electrode and coupled to the gate electrode;

wherein a shortest distance between the electron emission region and the counter electrode is smaller than a shortest distance between the cathode electrode and the counter electrode.

2. The electron emission device of claim 1, wherein the insulating layer is formed on the gate electrode, and the cathode electrode is formed on the insulating layer.

3. The electron emission device of claim 2, wherein the gate electrode and the cathode electrode are stripe-patterned and perpendicular to each other, and the receptor is formed at an intersection region of the gate electrode and the cathode electrode.

4. The electron emission device of claim 1, wherein the electron emission regions has a periphery opened toward the counter electrode, and the periphery placed within the receptor.

5. The electron emission device of claim 1, wherein the receptor narrows from a periphery of the cathode electrode to an inside of the cathode electrode.

6. The electron emission device of claim 5, wherein the lateral inclination θ of the receptor with respect to a width of the cathode electrode is set to satisfy the following condition:

$$\max\left[\tan^{-1}\left(\frac{-X}{2(W_v+G_v)}\right), -\frac{\pi}{2}\right] < \theta < \min\left[\tan^{-1}\left(\frac{P_h-X}{2(W_v+G_v)}\right), \frac{\pi}{2}\right]$$

in which X is a minimum width of the electron emission region in a longitudinal direction of the cathode electrode, Wv is a width of the electron emission region in a width direction of the cathode electrode, Gv is a distance between the electron emission region and a front end of the receptor in the width direction of the cathode electrode, and Ph is a pitch of a pixel region measured in the longitudinal direction of the cathode electrode.

7. The electron emission device of claim 5, wherein a minimum width of the receptor measured in a longitudinal direction of the cathode electrode is greater than or equal to a width of the counter electrode measured in the same direction.

8. The electron emission device of claim 1, wherein the receptor widens from a periphery of the cathode electrode to an inside of the cathode electrode.

9. The electron emission device of claim 8, wherein the lateral inclination θ of the receptor with respect to a width of the cathode electrode is set to satisfy the following formula:

$$\max\left[\tan^{-1}\left(\frac{P_h-X}{2(W_v+G_v)}\right), \frac{\pi}{2}\right] < \theta < \min\left[\tan^{-1}\left(\frac{-X}{2(W_v+G_v)}\right), -\frac{\pi}{2}\right]$$

in which X is a minimum width of the electron emission region in a longitudinal direction of the cathode electrode, Wv is a width of the electron emission region in a width direction of the cathode electrode, Gv is a distance between the electron emission region and a front end of the receptor in the width direction of the cathode electrode, and Ph is a pitch of a pixel region measured in the longitudinal direction of the cathode electrode.

10. The electron emission device of claim 8, wherein the counter electrode extends toward the receptor and forms a protrusion within the receptor.

11. The electron emission device of claim 2, wherein the cathode electrode has an electric field reinforcing internal portion exposing the insulating layer.

12. The electron emission device of claim 1, wherein the counter electrode is polygonal with four or more corners.

13. The electron emission device of claim 1, wherein the counter electrode contacts the gate electrode through a via hole in the insulating layer.

14. The electron emission device of claim 1, wherein the electron emission regions comprise a material selected from the group consisting of carbon nanotube, graphite, graphite nanofiber, diamond, diamond-like carbon, $C_{60}$, and silicon nanowire.

15. The electron emission device of claim 1, further comprising:

a second substrate facing the first substrate at a predetermined distance;

an anode electrode formed on the second substrate; and a phosphor layer formed on a surface of the anode electrode.

* * * * *